US011404199B2

(12) United States Patent
Morita

(10) Patent No.: US 11,404,199 B2
(45) Date of Patent: Aug. 2, 2022

(54) INDUCTOR

(71) Applicant: Murata Manufacturing Co., Ltd., Kyoto-fu (JP)

(72) Inventor: Yuusuke Morita, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 365 days.

(21) Appl. No.: 16/836,096

(22) Filed: Mar. 31, 2020

(65) Prior Publication Data

US 2020/0321156 A1 Oct. 8, 2020

(30) Foreign Application Priority Data

Apr. 2, 2019 (JP) ..... JP2019-070677

(51) Int. Cl.

| | |
|---|---|
| ***H01F 27/24*** | (2006.01) |
| ***H01F 27/29*** | (2006.01) |
| ***H01F 41/061*** | (2016.01) |
| ***H01F 41/02*** | (2006.01) |

(52) U.S. Cl.

CPC ..... *H01F 27/29* (2013.01); *H01F 27/24* (2013.01); *H01F 41/0246* (2013.01); *H01F 41/061* (2016.01)

(58) Field of Classification Search

CPC ..... H01F 27/29; H01F 27/24; H01F 41/0246; H01F 41/061; H01F 27/2852; H01F 27/292; H01F 2017/048; H01F 17/04; H01F 27/2847

See application file for complete search history.

(56) References Cited

U.S. PATENT DOCUMENTS

| | | | | |
|---|---|---|---|---|
| 2016/0322154 | A1 | 11/2016 | Park | |
| 2017/0103848 | A1* | 4/2017 | Yoneda | H01F 17/0013 |
| 2019/0027287 | A1* | 1/2019 | Kudo | H01F 27/29 |
| 2019/0043650 | A1* | 2/2019 | Tamura | H01F 17/045 |
| 2019/0318866 | A1* | 10/2019 | Mikogami | H01F 27/2828 |
| 2020/0411223 | A1* | 12/2020 | Satou | H01F 27/255 |
| 2021/0098184 | A1* | 4/2021 | Okuizumi | H01F 27/29 |
| 2022/0102047 | A1* | 3/2022 | Lee | H01F 17/04 |

FOREIGN PATENT DOCUMENTS

| | | | | |
|---|---|---|---|---|
| JP | 2010-147272 A | | 7/2010 | |
| JP | 2010-153459 A | | 7/2010 | |
| JP | 2010147272 A | * | 7/2010 | B29C 43/18 |
| JP | 2010153459 A | * | 7/2010 | |
| JP | 2013-115068 A | | 6/2013 | |

* cited by examiner

*Primary Examiner* — Pinping Sun
(74) *Attorney, Agent, or Firm* — Studebaker & Brackett PC

(57) ABSTRACT

An inductor includes a coil having a winding portion of a conductor wound in a two-stage spiral shape and an extended portion extended from the winding portion, an element body containing the coil, and an outer electrode. The winding portion is arranged such that a winding axis intersects a first pair of surfaces, is substantially orthogonal to the first pair of surfaces as viewed from a second pair of surface side, and intersects a normal line on the first pair of surfaces as viewed from a third pair of surfaces side. Respective pairs of surfaces are opposed to one another, and the winding axis is inclined in a direction where an exposed portion exposed on a surface of the element body is positioned closer to an intermediate surface at an equal distance from respective first pair of surfaces relative to the normal line on the first pair of surfaces.

20 Claims, 8 Drawing Sheets

INDUCTOR

CROSS-REFERENCE TO RELATED APPLICATION

This application claims benefit of priority to Japanese Patent Application No. 2019-070677, filed Apr. 2, 2019, the entire content of which is incorporated herein by reference.

BACKGROUND

Technical Field

The present disclosure relates to an inductor.

Background Art

Japanese Unexamined Patent Application Publication No. 2010-147272 discloses a mold coil including a coil formed by winding a conductor wire and a molded body in which a coil is sealed with magnetic material mold resin containing magnetic powder and resin. An end portion of an extended portion of the coil is exposed on a surface of the molded body, and a plating layer made of a conductive material and configuring an outer electrode is formed on the end portion of the extended portion and a periphery of the end portion. The plating layer forms the outer electrode connected to the end portion of the extended portion of the coil.

The coil is formed by winding a conductor having a coating layer in a substantially spiral shape of two stages so as to be connected to an innermost circumference, and the end portions of the extended portions are extended out from an outermost circumferences of respective stages to a surface of the molded body. As such, respective end portions are extended from different positions in a winding axis direction, and are exposed on the surface of the molded body. Since the conductor has the coating layer, it is necessary to remove the coating layer when the outer electrode and the end portion of the extended portion of the coil are connected to each other. Generally, a laser is used to remove the coating layer, and a region to be exposed of the coating layer is scanned with a substantially dot-like laser to remove the coating layer. Since exposed positions of the end portions are different in the winding axis direction at this time, for example, in a case where the end portion of the extended portion is exposed on both end surfaces of an element body to intend to scan the same range of both the end surfaces with the laser, the range to be scanned is widened. Furthermore, the exposed positions of the extended end portions may vary depending on forming of the extended portion, displacement of the extended portion during molding, and the like. Therefore, it is necessary to remove the coating layer by scanning a wide range in consideration of the range of variation with the laser, so that a machining time tends to be long.

SUMMARY

An aspect of the present disclosure is to provide an inductor with high productivity by narrowing a range to be scanned with a laser for removing a coating layer.

An inductor includes a coil having a winding portion in which a conductor having a coating layer is wound in a substantially spiral shape of two stages so as to be connected at an innermost circumference, an extended portion extended from an outermost circumference of the winding portion, an element body enclosing the coil and made of a magnetic material containing magnetic powder and resin, and an outer electrode arranged on a surface of the element body. A portion of an end portion of the extended portion along a length direction of the conductor is exposed as each exposed portion on the surface of the element body, and the portion of the end portion of the extended portion is connected to the outer electrode. The element body has a first pair of surfaces, a second pair of surfaces, and a third pair of surfaces, respective pairs of surfaces being arranged opposite to each other. The winding portion is arranged in a manner such that a winding axis of the coil intersects the first pair of surfaces, the winding axis is substantially orthogonal to the first pair of surfaces when viewed from the second pair of surfaces side, and the winding axis intersects a normal line on the first pair of surfaces when viewed from the third pair of surfaces side. The winding axis is inclined at a predetermined angle with respect to a normal line on the first pair of surfaces, and a position of the exposed portion is inclined at the predetermined angle toward a side closer to a center plane which is at an equal distance from each of the first pair of surfaces.

Other features, elements, characteristics and advantages of the present disclosure will become more apparent from the following detailed description of preferred embodiments of the present disclosure with reference to the attached drawings.

DETAILED DESCRIPTION

Figure 1:
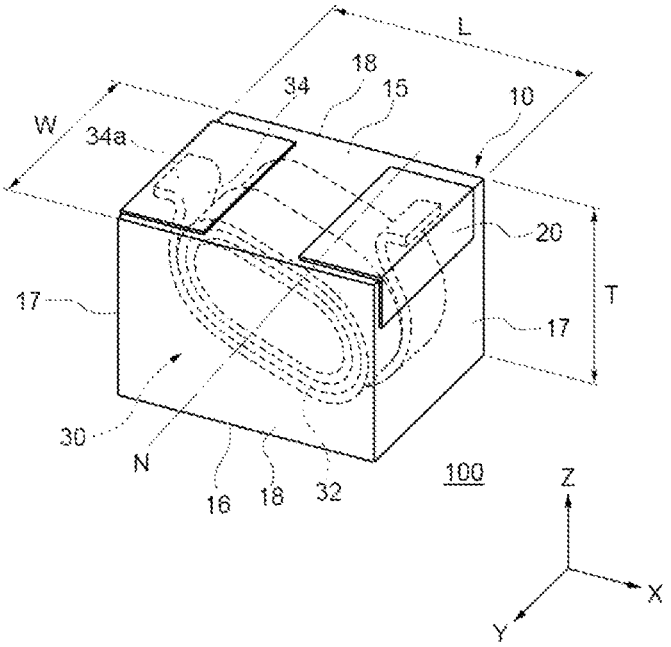
FIG. 1 is a partial transparent perspective view of an inductor of Embodiment 1 as viewed from a mounting surface side.

An inductor includes a coil having a winding portion in which a conductor having a coating layer is wound in a substantially spiral shape of two stages so as to be connected to an innermost circumference and an extended portion extended from an outermost circumference of the winding portion, an element body enclosing a coil and made of a magnetic material containing magnetic powder and resin, and an outer electrode arranged on a surface of the element body. A part of a surface along a length direction of the conductor at an end portion of the extended portion is exposed on the surface of the element body as each exposed portion, and is connected to the outer electrode. The element body has a first pair of surfaces, a second pair of surfaces, and a third pair of surfaces, respective pairs of surfaces being arranged opposite to one another. The winding portion is arranged in a manner such that a winding axis intersects the first pair of surfaces, is substantially orthogonal to the first pair of surfaces as viewed from the second pair of surfaces side, and intersects a normal line on the first pair of surfaces as viewed from the third pair of surfaces side. An intersecting direction between the winding axis and the normal line on the first pair of surfaces is inclined toward a side where a position of the exposed portion is closer to an intermediate surface which is at an equal distance from the respective first pair of surfaces.

The coil is arranged while the winding axis of the coil is inclined with respect to the surface of the element body in a manner such that the position of the exposed portion is closer to the intermediate surface between the first pair of surfaces, whereby the exposed portions come close to each other. Accordingly, a range to be scanned by a laser for removing the coating layer is narrowed, and a machining time is shortened so that productivity can be improved.

The exposed portion may be exposed on one surface of the third pair of surfaces. Thus, the end portion of the extended portion can be exposed on the mounting surface, and a DC resistance of the inductor can be reduced.

In the conductor at the exposed portion exposed on one surface of the third pair of surfaces, an end surface intersecting a length direction of the conductor may be substantially parallel to the second pair of surfaces. The end portion of the extended portion exposed from the element body has a substantially trapezoidal shape, and a connection area between the outer electrode and the extended portion can be made to be wide. Accordingly, the DC resistance of the inductor can be reduced, and reliability of connection between the extended portion and the outer electrode can be improved.

The exposed portions may be exposed to the respective surfaces of the second pair of surfaces. Since the exposed portions are brought close to each other in the winding axis direction, the range in which the coating layer is removed is narrowed, and the machining time is shortened so that the productivity can be improved.

The conductor at the exposed portion exposed on each surface of the second pairs of surfaces is such that the end surface intersecting the length direction of the conductor may be substantially parallel to the third pair of surfaces. The exposed portion has a substantially trapezoidal shape, and the connection area between the outer electrode and the extended portion can be made to be wide. Accordingly, the DC resistance of the inductor can be reduced, and the reliability of connection between the extended portion and the outer electrode can be improved.

The term "step" as used herein is intended to include not only an independent step but also a step in which a desired purpose of a step is achieved even though the step is not clearly distinguished from another step. Hereinafter, embodiments of the present disclosure will be described with reference to the accompanying drawings. However, the embodiments described below illustrate an inductor for embodying the technical idea of the present disclosure, and the present disclosure is not limited to the inductor described below. Note that the members described in the claims are not limited to the members of the embodiment. In particular, the dimensions, materials, shapes, relative arrangements, and the like of the components described in the embodiments are not intended to limit the scope of the present disclosure, and are merely illustrative. Note that in the drawings, the same reference numerals are given to the same portions. While the embodiments are shown in a separate manner in view of the ease of description or understanding of the gist, partial substitutions or combinations of the configurations described in the different embodiments are possible. In the description of Embodiment 2 and subsequent embodiments, common matters as those in Embodiment 1 will be omitted, and only different points will be described. In particular, similar operation and effect with the same configuration will not be described in order for each embodiment.

EMBODIMENTS

Embodiment 1

Figure 2:
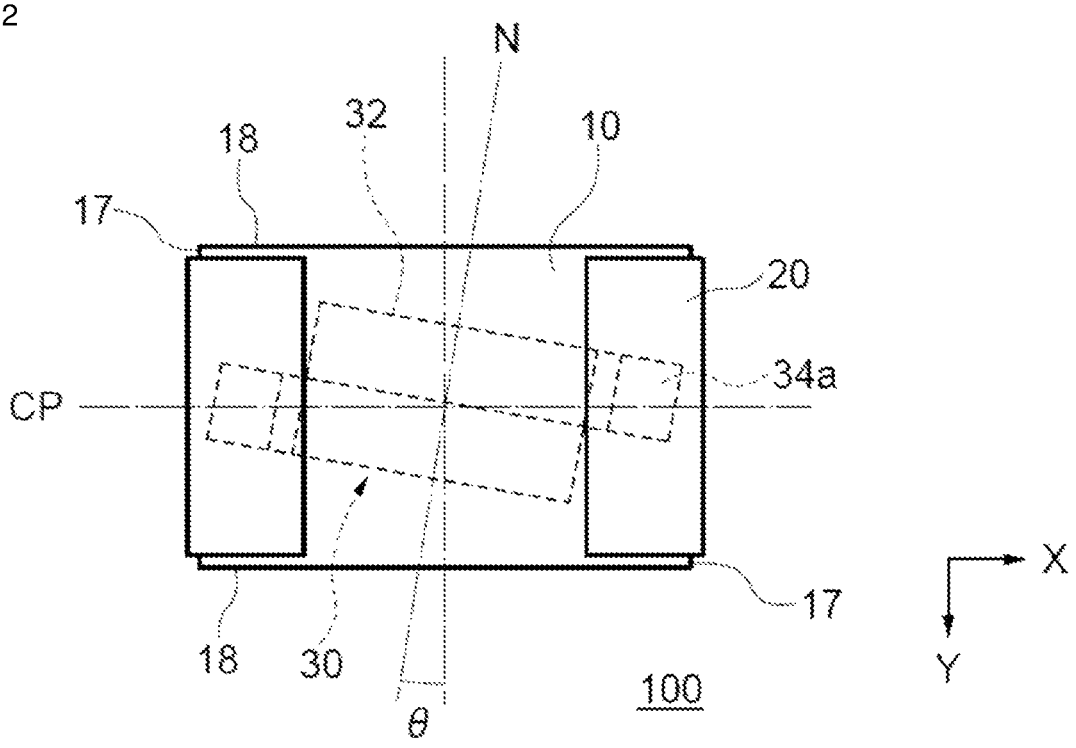
FIG. 2 is a partial transparent plan view of the inductor of Embodiment 1 as viewed from the mounting surface side.
Figure 3:
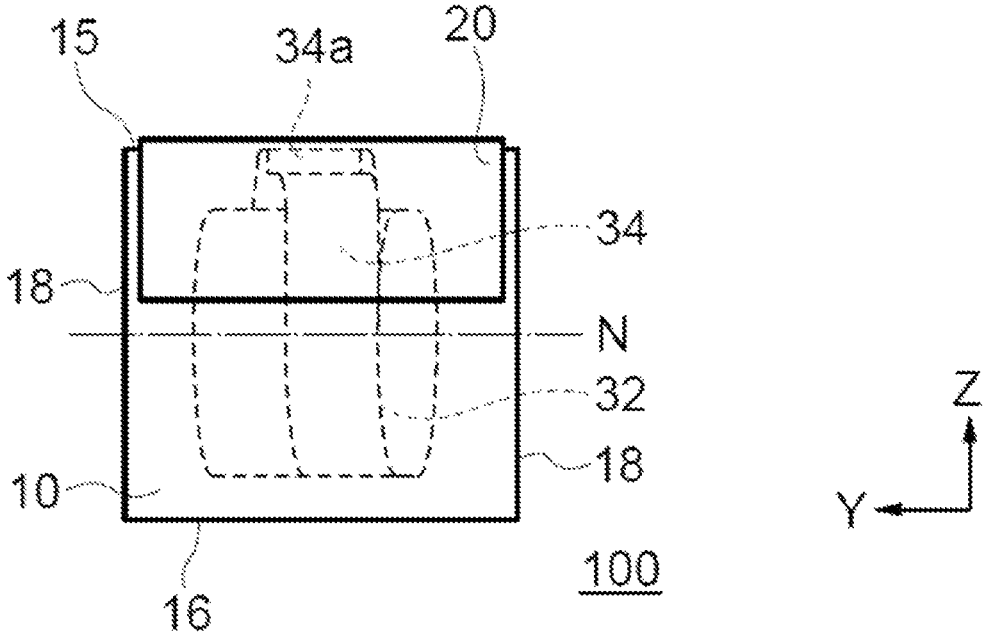
FIG. 3 is a partial transparent plan view of the inductor of Embodiment 1 as viewed from an end surface side of an element body.
Figure 4:
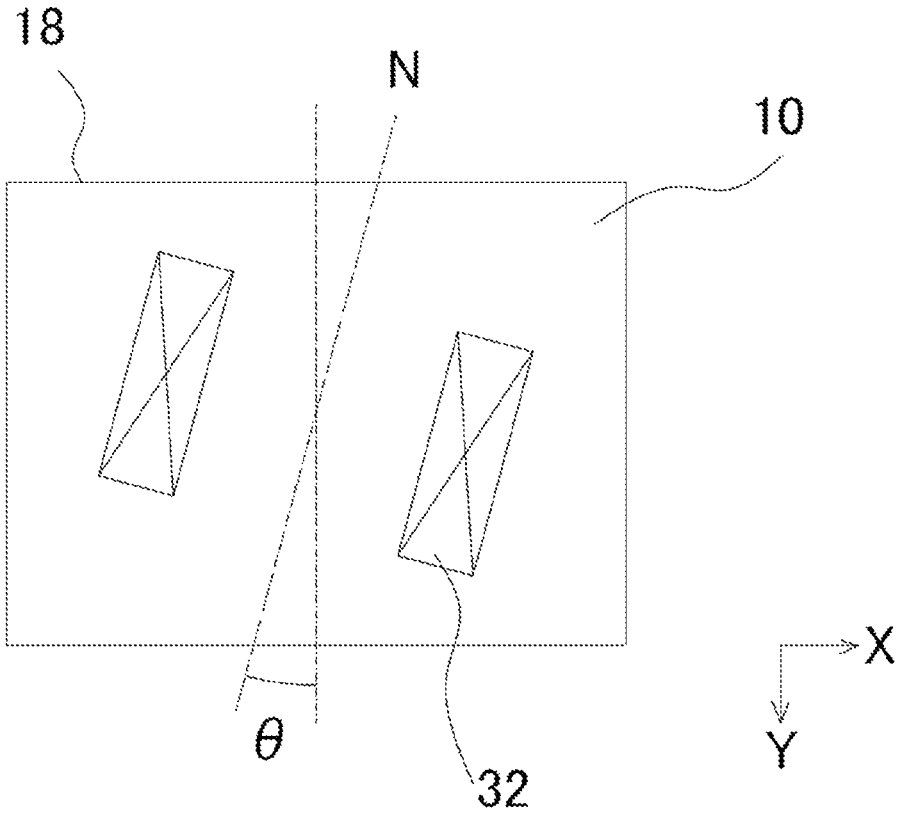
FIG. 4 is a schematic cross-sectional view of the inductor of Embodiment 1 at a plane parallel to the mounting surface and passing through a midpoint between the mounting surface and an upper surface.
Figure 5:
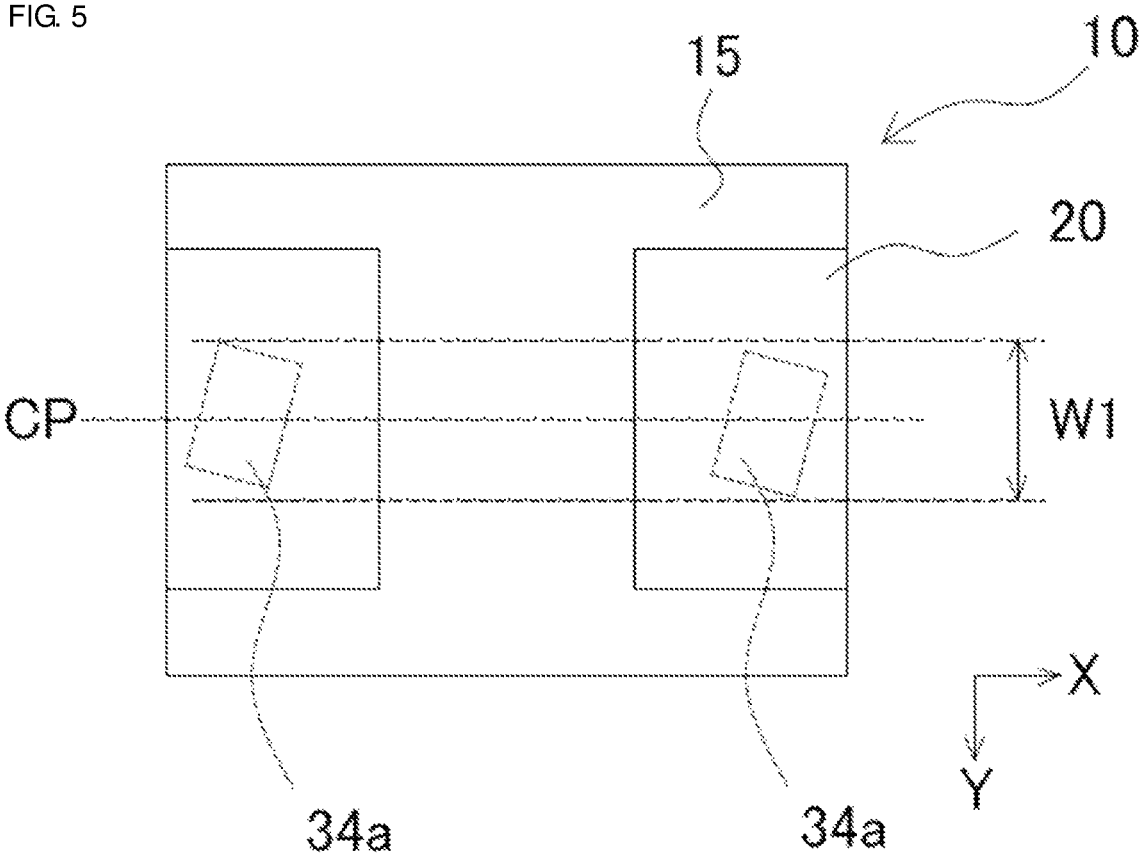
FIG. 5 is a partial transparent plan view of the inductor of Embodiment 1 as viewed from the mounting surface side.

An inductor of Embodiment 1 will be described with reference to FIG. 1 to FIG. 5. FIG. 1 illustrates a partial transparent perspective view of an inductor 100 as viewed from a mounting surface side. FIG. 2 illustrates a partial transparent plan view of the inductor 100 as viewed from the mounting surface side. FIG. 3 illustrates a partial transparent plan view of the inductor 100 as viewed from an end surface side of an element body. FIG. 4 is a schematic cross-sectional view of the inductor 100 at a plane parallel to the mounting surface and passing through a midpoint of a distance between the mounting surface and an upper surface, and FIG. 5 is a partial transparent plan view as viewed from the mounting surface side.

As illustrated in FIG. 1, the inductor 100 includes a coil 30, an element body 10 which is made of magnetic material containing magnetic powder and resin and encloses the coil 30, and a pair of outer electrodes 20 which are arranged on a surface of the element body 10 and are electrically connected to the coil 30. The element body 10 includes a mounting surface 15, an upper surface 16 opposed to the mounting surface 15, a pair of end surfaces 17 arranged opposite to each other and adjacent to the mounting surface 15 and the upper surface 16, and a pair of side surfaces 18 arranged opposite to one another and adjacent to the mounting surface 15, the upper surface 16, and the end surface 17. In the inductor 100, two side surfaces 18 configure a first pair of surfaces, two end surfaces 17 configure a second pair of surfaces, and the mounting surface 15 and the upper surface 16 configure a third pair of surfaces. The element body 10 has a shape defined by a length L in an X-axis direction, a width W in a Y-axis direction, and a height T in a Z-axis direction. The size of the element body 10 is, for example, L×W×T=about 2.5 mm×about 2.0 mm×about 2.0 mm Examples of the magnetic powder configuring the magnetic material include iron-based metal magnetic powder such as, Fe, Fe—Si—Cr, Fe—Ni—Al, Fe—Cr—Al, Fe—Si, Fe—Si—A, Fe—Ni, Fe—Ni—Mo, or the like, another composition-based metal magnetic powder, metallic magnetic powder such as amorphous, metal magnetic powder a surface of which is coated with an insulating material such as glass, metal magnetic powder having a modified surface, and nano-level fine metal magnetic powder. Examples of resin include thermosetting resin such as epoxy resin, polyimide resin, phenol resin, and the like, and thermoplastic resin such as polyethylene resin, polyamide resin, and the like.

The outer electrode 20 has a substantially L-shaped cross section and is arranged over the mounting surface 15 and the end surface 17. The coil 30 has a winding portion 32 and a pair of extended portions 34 respectively extended from an outermost circumference portion of the winding portion 32. The end portion of the extended portion 34 and the outer electrode 20 are electrically connected to each other. Although not illustrated, a surface of the element body except for a portion at which the outer electrode 20 is provided may be covered with exterior resin. The outer electrode 20 is formed, for example, by performing plating treatment on a surface of the element body 10 including an exposed portion 34*a*. The plating treatment may include, for example, a step of forming a plating layer on the surface of the element body 10 by copper plating, a subsequent nickel plating step, a tin plating step, and the like.

The winding portion 32 of the coil 30 is formed by winding (so-called alpha winding) into vertical two-stage shape a conductor (so-called rectangular wire) having a coating layer and having, for example, a substantially rectangular cross section in a state in which both ends of the conductor are positioned at the outermost circumference portion and connected to each other at the innermost circumference portion. The cross section orthogonal to a length direction of the conductor is, for example, a substantially rectangle, and is defined by a width corresponding to a long side of the rectangle and a thickness corresponding to a short side of the rectangle. The winding portion 32 is arranged while a direction of a winding axis N thereof is made to intersect the side surface 18 which is the first pair of surfaces, and is enclosed in the element body 10. The extended portion 34 is extended from the outermost circumference of each stage of the winding portion 32 toward the mounting surface 15 side of the element body 10, and the end portion of the extended portion 34 is arranged along the mounting surface 15. That is, the extended portion 34 is extended in a Z direction from the winding portion 32 so as to be orthogonal to the mounting surface 15 which is an L×W plane, and is bent in a manner such that a wide surface defined by the length direction and the width of the conductor at the end portion of the extended portion extends to the mounting surface 15. The exposed portion 34*a* in which a part of the wide surface of the conductor is exposed from the mounting surface 15 is provided on the mounting surface 15 side of the end portion of the extended portion 34, and is electrically connected to the outer electrode 20.

The conductor has a width of, for example, equal to or more than about 120 μm and equal to or less than about 350 μm (i.e., from about 120 μm to about 350 μm), and a thickness of, for example, equal to or more than about 10 μm and equal to or less than about 150 μm (i.e., from about 10 μm to about 150 μm). Further, the coating layer of the conductor is formed of insulating resin such as polyamide imide having a thickness of, for example, equal to or more than about 2 μm and equal to or less than about 10 μm (i.e., from about 2 μm to about 10 μm), and preferably about 6 μm. A self-fusing layer containing a self-fusion component such as thermoplastic resin or thermosetting resin is further provided on a surface of the coating layer, and may be formed so that a thickness thereof is equal to or more than about 1 μm and equal to or less than about 3 μm (i.e., from about 1 μm to about 3 μm).

As illustrated in FIG. 2, the winding portion 32 of the coil 30 is enclosed in the element body 10 in a state in which the winding axis N is substantially parallel to the mounting surface 15 and rotated or inclined by a predetermined angle θ in a right-handed direction (clockwise) with respect to a normal direction of the side surface 18 (L×T), that is, the Y-axis direction, when viewed from a normal direction of the mounting surface 15 (L×W), that is, the Z-axis direction. As illustrated in FIG. 3, the winding portion 32 of the coil 30 is enclosed in the element body 10 in a manner such that the winding axis N is substantially parallel to the mounting surface 15 and substantially orthogonal to the side surface 18 (L×T) as viewed from a normal direction of the end surface 17 (W×T), that is, the X-axis direction. As illustrated in FIG. 4, the winding portion 32 of the coil is enclosed in the element body 10 in a manner such that the winding axis N is rotated or inclined clockwise by the predetermined angle θ with respect to the normal direction of the side surface 18. The predetermined angle θ may be, for example, equal to or more than about 5° and equal to or less than about 15° (i.e., from about 5° to about) 15°.

Here, as illustrated in FIGS. 2 and 5, a center plane CP is substantially orthogonal to the mounting surface 15 and the end surface 17, and substantially parallel to the side surfaces 18. The center plane CP passes through the half of a distance between the side surfaces 18. A rotational direction of the winding axis N with respect to the Y-axis direction is inclined in a direction closer to the center plane CP. Positions of the two exposed portions 34*a* are respectively inclined closer to the center plane CP.

Reference Embodiment 1

Figure 6:
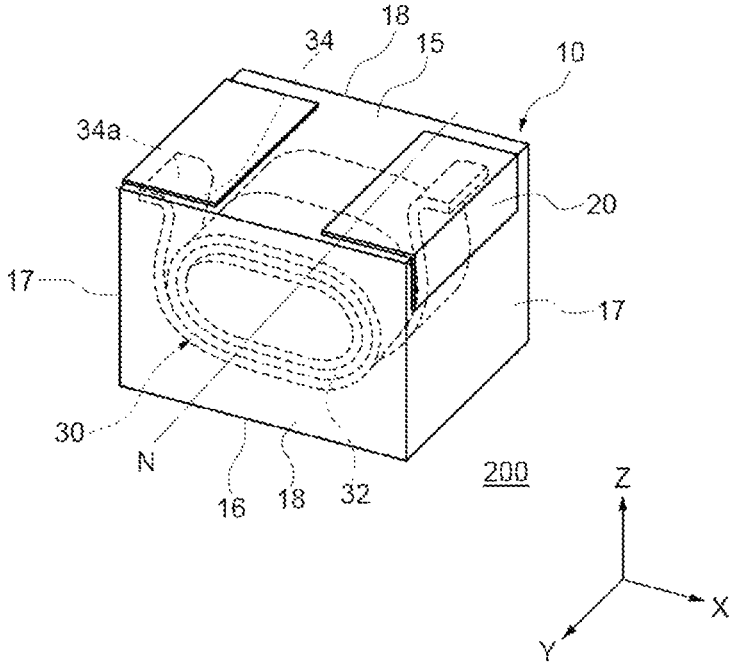
FIG. 6 is a partial transparent perspective view of an inductor of Reference Example 1 as viewed from a mounting surface side.
Figure 7:
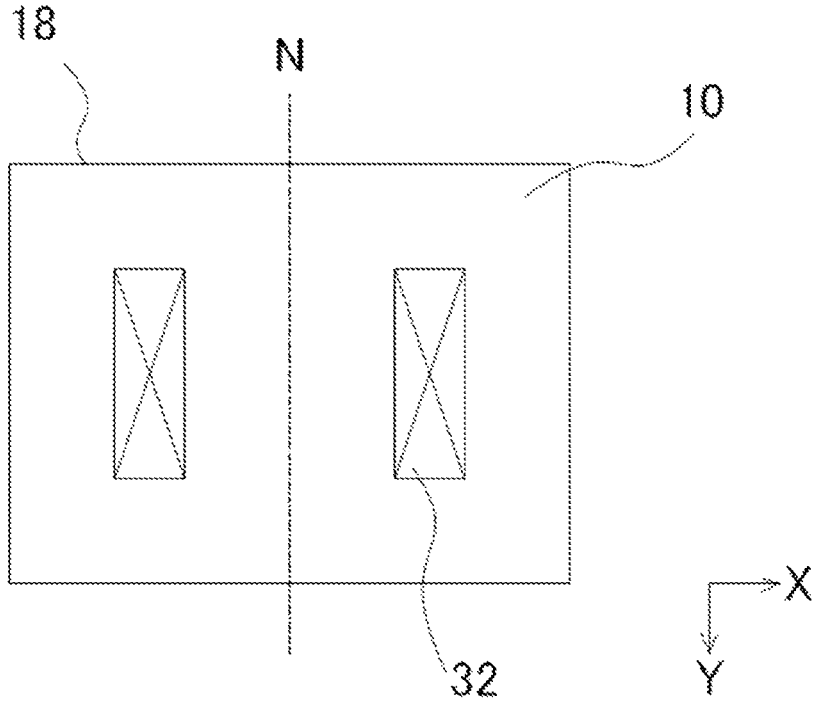
FIG. 7 is a schematic cross-sectional view of the inductor of Reference Example 1 at a plane parallel to the mounting surface and passing through a midpoint between the mounting surface and an upper surface.
Figure 8:
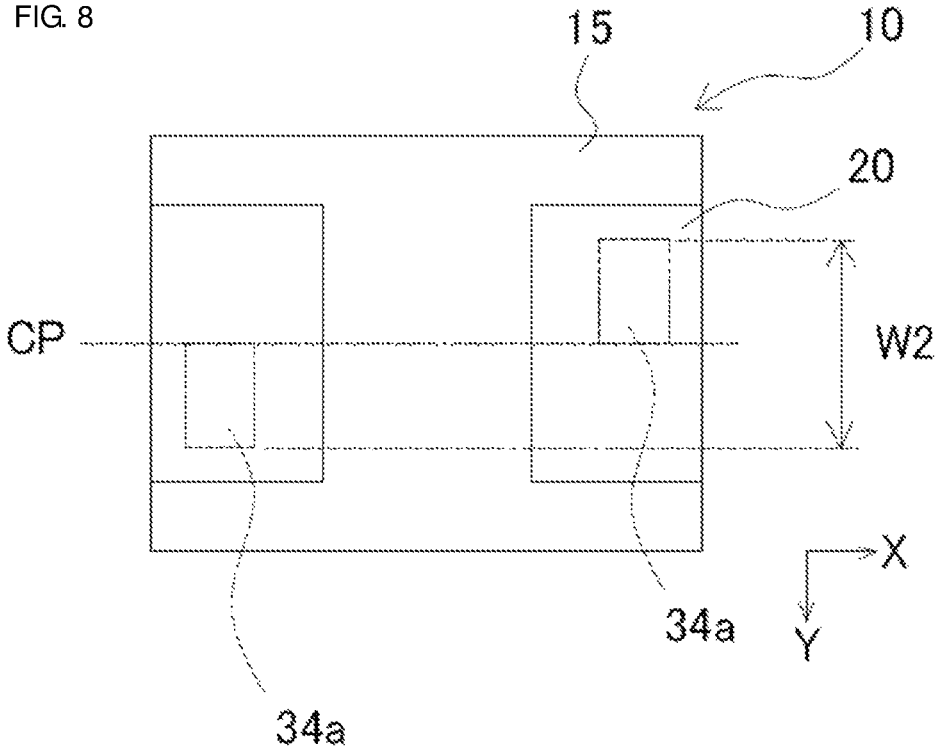
FIG. 8 is a partial transparent plan view of the inductor of Reference Example 1 as viewed from the mounting surface side.

An existing inductor 200 will be described with reference to FIG. 6 to FIG. 8 as Reference Example 1 . FIG. 6 illustrates a partial transparent perspective view of the inductor 200 as viewed from a mounting surface side. FIG. 7 is a schematic cross-sectional view at a plane parallel to the mounting surface and passing through a midpoint between the mounting surface and an upper surface, and FIG. 8 is a partial transparent plan view as viewed from the mounting surface side. The inductor 200 is configured similarly to the inductor 100 except that the winding portion 32 is arranged in a manner such that the winding axis N of the coil 30 is substantially orthogonal to the side surface 18 which is the first pair of surfaces, and is substantially parallel to the mounting surface 15, the upper surface 16, and the end surface 17.

In the inductor 200, as illustrated in FIG. 6, the winding portion 32 is enclosed in the element body 10 in a manner such that the winding axis N is substantially orthogonal to the side surface 18. As such, as illustrated in FIG. 7, an opening surface of the winding portion 32 is substantially parallel to the side surface 18 of the element body 10. The extended portion is extended in the Z-axis direction while being substantially parallel to the side surface of the element body 10, and the exposed portion 34*a* is exposed from the mounting surface 15.

In a case where the exposed portion is formed at the end portion of the extended portion by removing the coating layer, in the inductor 200, a minimum width of a range in the Y-axis direction to be scanned by a laser is W2, as illustrated in FIG. 8. On the other hand, in the inductor 100, a minimum width of the scanning range in the Y-axis direction is W1 as illustrated in FIG. 5, and a narrow region is sufficient compared with the inductor 200. Accordingly, the machining time can be shortened and the productivity can be improved.

Next, a method for manufacturing the inductor will be described. The method for manufacturing the inductor includes a preparation step for preparing a coil having, for example, a desired shape, a housing step for housing the prepared coil in a first temporary molded body having a substantially E-shaped cross section containing magnetic powder and resin to cover an opening portion of the first temporary molded body in which the coil is housed with a substantially plate-like second temporary molded body, a molding step for pressuring the first temporary molded body and the second temporary molded body housing the coil in a mold to obtain the element body integrated with the coil, and an outer electrode forming step for arranging the outer electrode on a surface of the element body.

Figure 9:
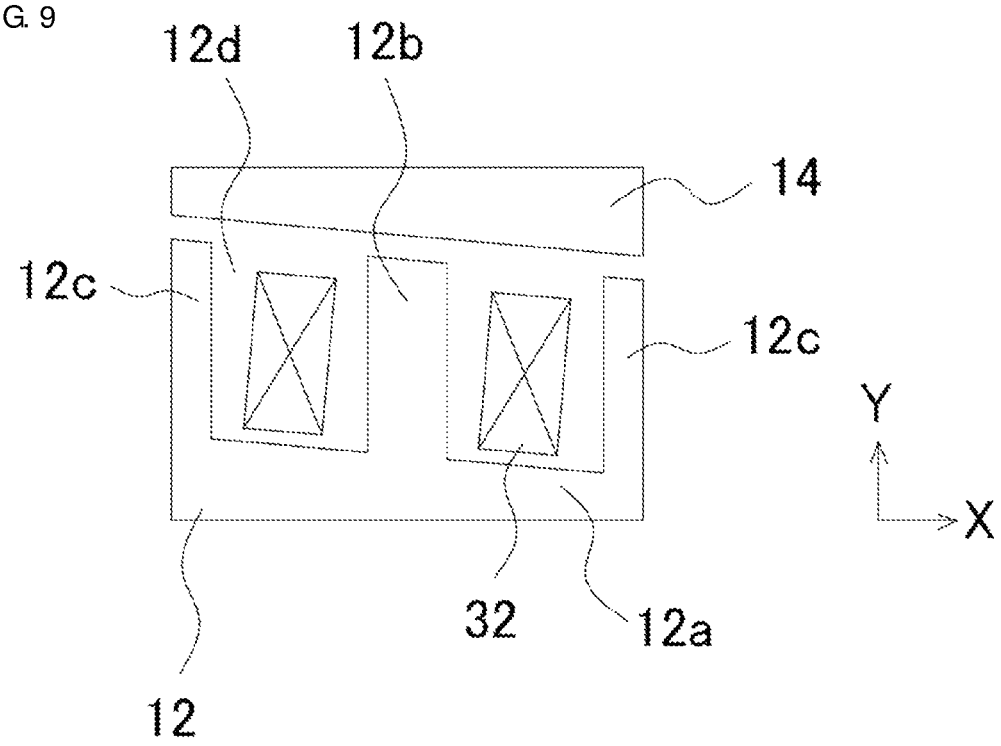
FIG. 9 is a schematic cross-sectional view illustrating one step of a method for manufacturing the inductor of Embodiment 1.

In the preparation step, the coil having a winding portion in which the conductor having the coating layer is wound in a substantially spiral shape of two stages so as to be connected to the innermost circumference and the extended portion extended from the outermost circumference of the winding portion is prepared. As illustrated in the schematic cross-sectional view of FIG. 9, a first temporary molded body 12 in the housing step includes a bottom surface portion 12*a* for holding the winding portion 32 of the coil in an inclined state, a middle leg portion 12*b* provided on the bottom surface portion 12*a* and inserted into an inner space of the winding portion 32, and a wall portion 12*c* arranged so as to surround an outer edge of the bottom surface portion 12*a*. Although not illustrated in the figure, the wall portion 12*c* is provided with a cutout portion for extending the end portion of the extended portion of the coil on the surface of the element body. In the housing step, the middle leg portion 12*b* is inserted into a winding shaft of the winding portion 32, and the winding portion 32 is arranged on the bottom surface portion 12*a* in a manner such that the wall portion 12*c* surrounds the winding portion 32. The extended portion of the coil is extended from the cutout portion of the first temporary molded body 12 to a side of the mounting surface formed so as to be substantially orthogonal to the Z-axis direction, and is bent so as to be along an outer circumference of the wall portion 12*c* forming the mounting surface. The opening portion 12*d* provided so as to intersect the Y-axis direction of the first temporary molded body 12 is covered with the plate-like second temporary molded body, so that the coil is housed in the first temporary molded body and the second temporary molded body. In the molding step, the first temporary molded body and the second temporary molded body housing the coil are heated and pressurized in the mold to obtain the element body integrated with the coil. Then, in the outer electrode forming step, the coating layer of the conductor exposed on the mounting surface is removed by scanning with a laser. Finally, by a plating treatment, the exposed portion from which the coating layer has been removed is covered to form the outer electrode on the surface of the element body. In the outer electrode forming step, an outer electrode may be formed by applying a conductive paste instead of the plating treatment.

Embodiment 2

Figure 10:
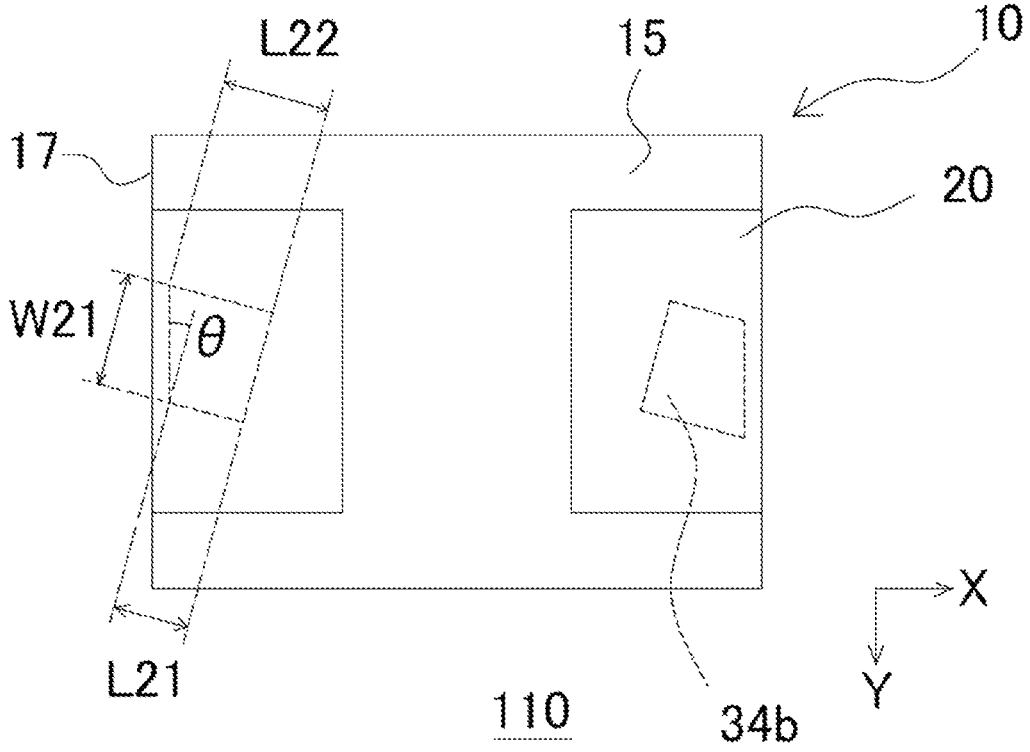
FIG. 10 is a partial transparent plan view of an inductor of Embodiment 2 as viewed from a mounting surface side.

An inductor 110 of Embodiment 2 will be described with reference to FIG. 10. FIG. 10 illustrates a partial transparent plan view as viewed from a mounting surface side of the inductor 110. The inductor 110 is configured in the same manner as the inductor 100 except that the shape of the exposed portion is different.

As illustrated in FIG. 10, in the inductor 110, an end surface of the conductor intersecting the length direction of the conductor (a cross section of the conductor orthogonal to a length direction of the conductor) at the end portion of the extended portion 34 is substantially parallel to the end surface 17 which is the second pair of surfaces. As such, the exposed portion 34*b* has a substantially trapezoidal shape defined by a length L21 of an upper bottom, a length L22 of a lower bottom, and a height W21. A height direction of the trapezoid, that is, a width direction of the conductor intersects the end surface 17, for example, at the angle θ. Further, the exposed portion 34*b* is covered with the outer electrode 20.

Figure 11:
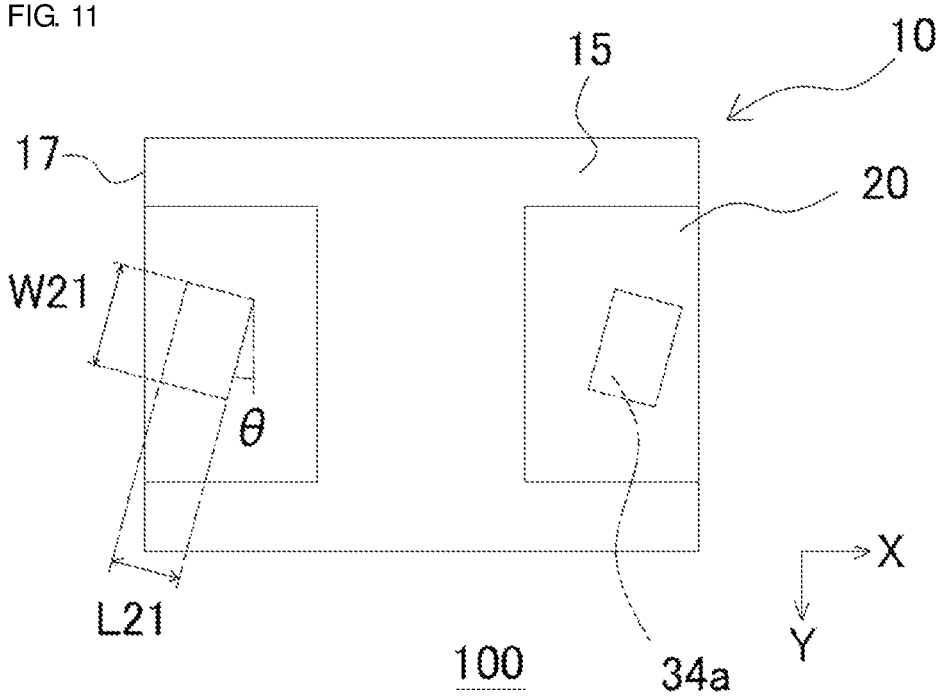
FIG. 11 is a partial transparent plan view of the inductor of Embodiment 1 as viewed from the mounting surface side.
Figure 12:
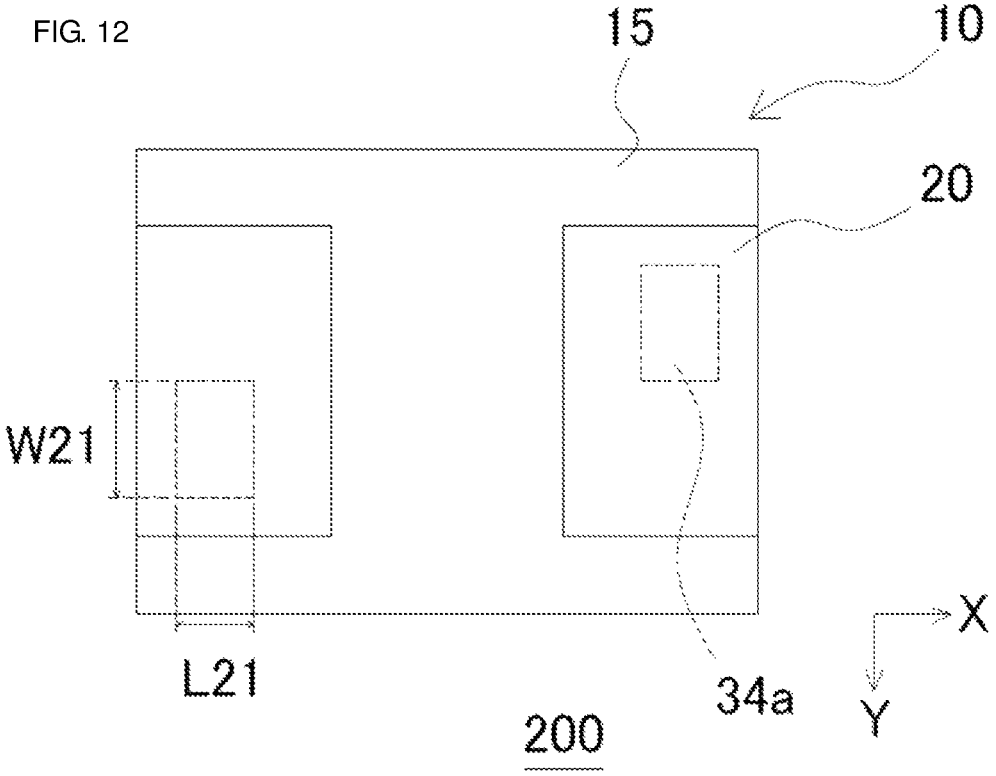
FIG. 12 is a partial transparent plan view of the inductor of Reference Example 1 as viewed from the mounting surface side.

On the other hand, as illustrated in FIG. 11, in the inductor 100, the end surface intersecting the length direction at the end portion of the extended portion is substantially orthogonal to the length direction of the conductor. As such, the exposed portion 34*a* has a substantially rectangular shape defined by the width W21 of the conductor and the length L21 of the conductor, and the width direction of the conductor intersects the end surface 17, for example, at the angle θ. Further, as illustrated in FIG. 12, in the inductor 200, the exposed portion 34*a* has a substantially rectangular shape as in the case of the inductor 100, and the width direction of the conductor is substantially parallel to the end surface 17.

Since an area of the exposed portion 34*b* of the inductor 110 is larger than an area of the exposed portion 34*a* of the inductors 100 and 200, an area of connection with the outer electrode is increased. Accordingly, a DC resistance of the inductor 110 is further reduced, and the reliability of connection between the extended portion and the outer electrode is improved.

Embodiment 3

Figure 13:
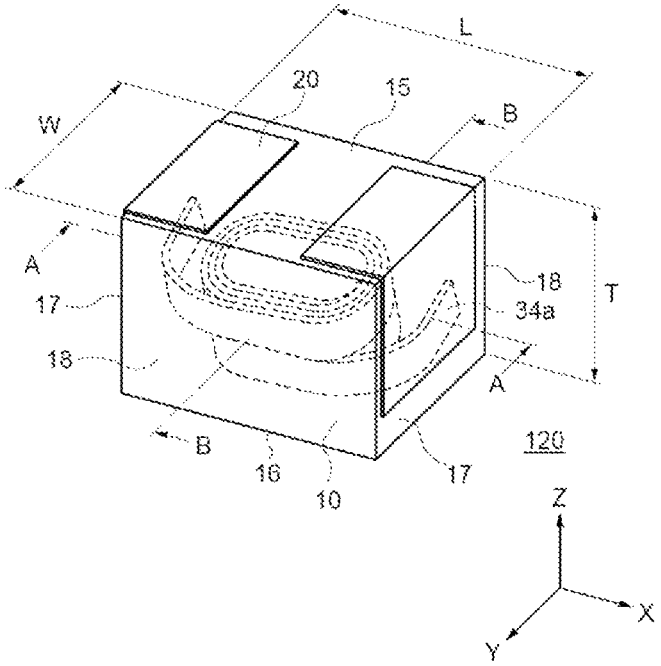
FIG. 13 is a partial transparent perspective view of an inductor of Embodiment 3 as viewed from a mounting surface side.
Figure 14:
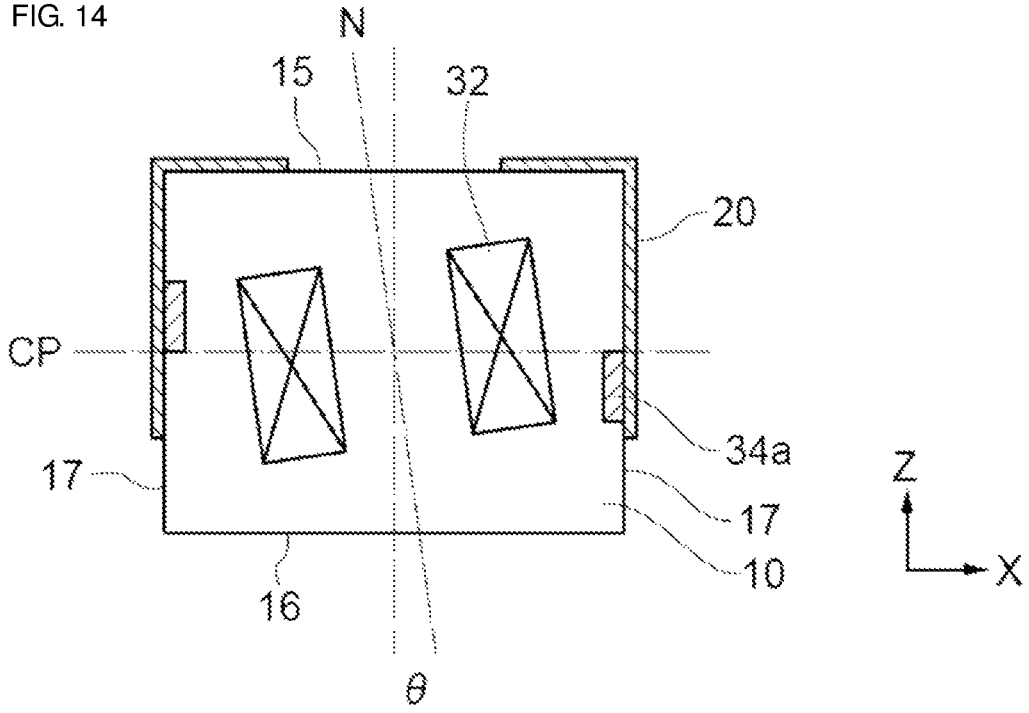
FIG. 14 is a schematic cross-sectional view at a plane orthogonal to the mounting surface taken along a line A-A in FIG. 13.
Figure 15:
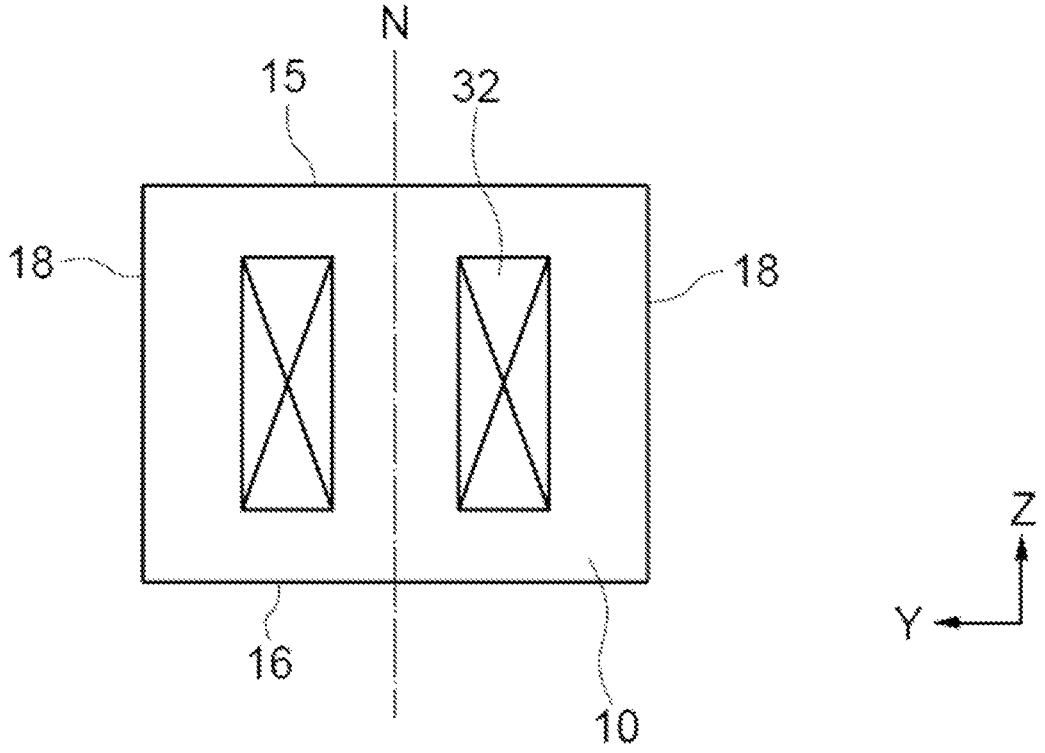
FIG. 15 is a schematic cross-sectional view at a plane orthogonal to the mounting surface taken along a line B-B in FIG. 13.

An inductor 120 of Embodiment 3 will now be described with reference to FIG. 13 to FIG. 15. FIG. 13 illustrates a partial transparent perspective view of the inductor 120 as viewed from a mounting surface side. FIG. 14 is a schematic cross-sectional view at a plane orthogonal to the mounting surface taken along a line A-A in FIG. 13. FIG. 15 is a schematic cross-sectional view at a plane orthogonal to the mounting surface taken along a line B-B in FIG. 13. The inductor 120 is configured in the same manner as the inductor 100 except that the winding portion is arranged while the winding axis N of the coil intersects the mounting surface and the upper surface, that the extended portions are respectively extended to the end surface side of the element body, and that the exposed portion is provided on the end surface of the element body.

In the inductor 120, the mounting surface 15 and the upper surface 16 of the element body 10 are formed as the first pair of surfaces, the end surface 17 is formed as the second pair of surfaces, and the side surface 18 is formed as the third pair of surfaces. In the inductor 120, the extended portion is extended from the winding portion toward a direction of the two end surfaces 17 of the element body 10 respectively, and the wide surface defined by the length direction and the width of the conductor at the end portion of the extended portion is bent so as to extend to the end surface 17. The exposed portion 34*a* in which a part of the wide surface of the conductor is exposed from an end surface 17 is provided on the end surface 17 side of the end portion of the extended portion, and is electrically connected to the outer electrode 20. The outer electrode 20 is provided over the end surface 17 and the mounting surface 15 of the element body.

As illustrated in FIG. 14, the winding portion 32 of the coil is substantially parallel to the side surface 18 (L×T), and is enclosed in the element body 10 in a state in which the winding axis N is rotated or inclined by the angle θ in a left-handed direction (counterclockwise) with respect to the normal direction (i.e., Z-axis direction) of the mounting surface 15 when viewed from the normal direction (i.e., Y-axis direction) of the side surface 18 (L×T). As illustrated in FIG. 15, the coil winding portion 32 is enclosed in the element body 10 in a manner such that the winding axis N is substantially orthogonal to the mounting surface 15 and the upper surface 16 and substantially parallel to the side surface 18 (L×T) when viewed from the normal direction (i.e., X-axis direction) of the end surface 17 (W×T). In the inductor 120, since the winding portion is arranged while the winding axis N of the coil intersects the mounting surface 15 and the upper surface 16, the inductor can be made to have a low height.

The rotational direction of the winding axis N with respect to the Z-axis direction is substantially parallel to the mounting surface 15 and the upper surface 16 and is substantially orthogonal to the end surface 17 and the side surface 18, and is a direction in which the positions of the two exposed portions 34*a* are respectively closer to the center plane CP passing through a position at a half of the distance between the mounting surface 15 and the upper surface 16.

In the inductor 120, the end surface of the conductor at the end portion of the extended portion 34 is substantially orthogonal to the length direction of the conductor, and the exposed portion 34*a* is formed in a substantially rectangular shape. The end surface of the conductor intersecting the length direction of the conductor (a cross section of the conductor orthogonal to a length direction of the conductor) may be substantially parallel to the side surface 18 which is the third pair of surfaces. The exposed portion has a substantially trapezoidal shape, and the connection area between the outer electrode and the extended portion can be made wide. Accordingly, a DC resistance of the inductor 120 is further reduced, and the reliability of connection between the extended portion and the outer electrode is improved.

In the above embodiment, although the element body has a substantially rectangular parallelepiped shape, each of the sides forming the substantially rectangular parallelepiped shape may be chamfered.

The winding portion of the coil may have a substantially circular shape, a substantially oval shape, a substantially elliptical shape, a substantially polygonal shape, or the like as viewed from the winding axis direction.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a coil having a winding portion in which a conductor having a coating layer is wound in a substantially spiral shape of two stages that are connected at an innermost circumference, and at least one extended portion extended from an outermost circumference of the winding portion;

an element body enclosing the coil and made of a magnetic material containing magnetic powder and resin, the element body having a first pair of surfaces arranged opposite to each other, a second pair of surfaces arranged opposite to each other, and a third pair of surfaces arranged opposite to each other; and at least one outer electrode arranged on one of the surfaces of the first pair of surfaces, the second pair of surfaces or the third pair of surfaces of the element body, wherein a portion of an end portion of the at least one extended portion along a length direction of the conductor is exposed as an exposed portion at one of the surfaces of the first pair surfaces, the second pair of surfaces or the third pair of surfaces of the element body, and the exposed portion is connected to the at least one outer electrode, the winding portion is arranged in a manner such that a winding axis of the coil intersects the first pair of surfaces, the winding axis is substantially orthogonal to the first pair of surfaces when viewed from a side of the second pair of surfaces, and the winding axis intersects a normal line that extends in a direction normal to the first pair of surfaces when viewed from a side of the third pair of surfaces, the winding axis is inclined at a predetermined angle with respect to the normal line, and a position of the exposed portion is inclined at the predetermined angle toward a side closer to a center plane which is at an equal distance from each of the surfaces of the first pair of surfaces.

2. The inductor according to claim 1, wherein the exposed portion is exposed at one of the surfaces of the third pair of surfaces.

3. The inductor according to claim 2, wherein a cross section of the conductor orthogonal to the length direction of the conductor is substantially parallel to the second pair of surfaces.

4. The inductor according to claim 1, wherein the at least one extended portion includes a plurality of extended portions, and the exposed portion of each of the plurality of extended portions are each exposed at a respective one of the surfaces of the second pair of surfaces.

5. The inductor according to claim 4, wherein a cross section of the conductor orthogonal to the length direction of the conductor is substantially parallel to the third pair of surfaces.

6. The inductor according to claim 1, wherein the at least one extended portion includes a plurality of extended portions, and the exposed portion of each of the plurality of extended portions is each exposed at one of the surfaces of the third pair of surfaces.

7. The inductor according to claim 6, wherein the at least one outer electrode includes a plurality of outer electrodes arranged at opposite ends of the one of the surfaces of the third pair of surfaces, such that the exposed portion of each of the plurality of extended portions is connected to a respective one of the plurality of outer electrodes.

8. The inductor according to claim 1, wherein the at least one outer electrode is arranged on two of the surfaces of the first pair of surfaces, the second pair of surfaces or the third pair of surfaces of the element body.

9. The inductor according to claim 1, wherin the at least one outer electrode includes a plurality of outer electrodes, arranged on the one of the surfaces of the first pair of surfaces, the second pair of surfaces or the third pair of surfaces of the element body.

10. The inductor according to claim 9, wherein the plurality of outer electrodes are arranged at opposite ends of the one of the surfaces of the first pair of surfaces, the second pair of surfaces or the third pair of surfaces of the element body.

11. The inductor according to claim 9, wherein the plurality of outer electrodes are each arranged on two of the surfaces of the first pair of surfaces, the second pair of surfaces or the third pair of surfaces of the element body.

12. The inductor according to claim 1, wherein the at least one extended portion includes a plurality of extended portions, and the exposed portion of each of the plurality of extended portions is inclined at the predetermined angle toward the side closer to the center plane.

13. The inductor according to claim 1, wherein the exposed portion has a trapezoidal shape.

14. The inductor according to claim 13, wherein the exposed portion is exposed at one of the surfaces of the third pair of surfaces, and an edge of the exposed portion is substantially parallel to one of the surfaces of the second pair of surfaces.

15. The inductor according to claim 13, wherein the exposed portion is exposed at one of the surfaces of the third pair of surfaces, and a height direction of the exposed portion having the trapezoidal shape intersects one of the surfaces of the second pair of surfaces at the predetermined angle.

16. The inductor according to claim 1, wherein the exposed portion has a rectangular shape.

17. The inductor according to claim 16, wherein the exposed portion is exposed at one of the surfaces of the third pair of surfaces, and a width direction of the conductor at the exposed portion extends at the predetermined angle to one of the surfaces of the second pair of surfaces.

18. The inductor according to claim 16, wherein the exposed portion is exposed at one of the surfaces of the third pair of surfaces, and a width direction of the conductor at the exposed portion extends substantially parallel to one of the surfaces of the second pair of surfaces.

19. The inductor according to claim 1, wherein one of the surfaces of the first pair of surfaces is a mounting surface.

20. The inductor according to claim 19, wherein the exposed portion is exposed at one of the surfaces of the second pair of surfaces.

* * * * *